US008293444B2

(12) United States Patent
Pawlak et al.

(10) Patent No.: US 8,293,444 B2
(45) Date of Patent: Oct. 23, 2012

(54) PURIFIED POLYESTER RESINS FOR TONER PERFORMANCE IMPROVEMENT

(75) Inventors: John L. Pawlak, Rochester, NY (US); Timothy L. Lincoln, Rochester, NY (US); William H. Hollenbaugh, Jr., Rochester, NY (US); Yuhua Tong, Webster, NY (US); Brendan H. Williamson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 547 days.

(21) Appl. No.: 12/490,795

(22) Filed: Jun. 24, 2009

(65) Prior Publication Data

US 2010/0330485 A1 Dec. 30, 2010

(51) Int. Cl.
*G03G 9/00* (2006.01)

(52) U.S. Cl. ..... 430/109.4; 430/108.1; 430/108.4; 430/109.1

(58) Field of Classification Search ..... 430/108.1, 430/108.4, 109.1, 109.3, 109.4
See application file for complete search history.

(56) References Cited

U.S. PATENT DOCUMENTS

| | | | |
|---|---|---|---|
| 2,762,788 | A | 9/1956 | Siggel et al. |
| 3,681,106 | A | 8/1972 | Burns et al. |
| 3,847,604 | A | 11/1974 | Hagenbach et al. |
| 3,935,169 | A | 1/1976 | Reen |
| 4,064,079 | A | 12/1977 | Sidebotham et al. |
| 4,246,332 | A | 1/1981 | Tanaka et al. |
| 4,295,990 | A | 10/1981 | Verbeek et al. |
| 4,523,591 | A | 6/1985 | Kaplan et al. |
| 4,533,614 | A | 8/1985 | Fukumoto et al. |
| 4,591,629 | A | 5/1986 | El-Ghatta et al. |
| 4,810,775 | A | 3/1989 | Bendix et al. |
| 4,845,006 | A | 7/1989 | Matsubara et al. |
| 4,863,824 | A | 9/1989 | Uchida et al. |
| 4,863,825 | A | 9/1989 | Yoshimoto et al. |
| 4,894,308 | A | 1/1990 | Mahabadi et al. |
| 4,917,983 | A | 4/1990 | Uchida et al. |
| 4,931,370 | A | 6/1990 | Amaya et al. |
| 4,933,252 | A | 6/1990 | Nishikawa et al. |
| 4,935,326 | A | 6/1990 | Creatura et al. |
| 4,937,166 | A | 6/1990 | Creatura et al. |
| 4,957,774 | A | 9/1990 | Doi et al. |
| 4,973,439 | A | 11/1990 | Chang et al. |
| 4,973,539 | A | 11/1990 | Sacripante et al. |
| 4,980,448 | A | 12/1990 | Tajiri et al. |
| 4,981,939 | A | 1/1991 | Matsumura et al. |
| 4,988,794 | A | 1/1991 | Kubo et al. |
| 5,004,664 | A | 4/1991 | Fuller et al. |
| 5,049,647 | A | 9/1991 | El-Ghatta et al. |
| 5,057,392 | A | 10/1991 | McCabe et al. |
| 5,057,596 | A | 10/1991 | Kubo et al. |
| 5,143,809 | A | 9/1992 | Kaneko et al. |
| 5,145,762 | A | 9/1992 | Grushkin |
| 5,147,747 | A | 9/1992 | Wilson et al. |
| 5,156,937 | A | 10/1992 | Alexandrovich et al. |
| 5,202,212 | A | 4/1993 | Shin et al. |
| 5,227,460 | A | 7/1993 | Mahabadi et al. |
| 5,231,135 | A | 7/1993 | Machell et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,376,494 | A | 12/1994 | Mahabadi et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,466,554 | A * | 11/1995 | Sacripante et al. ..... 430/109.4 |
| 5,468,586 | A | 11/1995 | Proper et al. |
| 5,478,921 | A | 12/1995 | Roby et al. |
| 5,480,756 | A | 1/1996 | Mahabadi et al. |
| 5,496,676 | A | 3/1996 | Croucher et al. |
| 5,500,324 | A | 3/1996 | Mahabadi et al. |
| 5,501,935 | A | 3/1996 | Patel et al. |
| 5,527,658 | A | 6/1996 | Hopper et al. |
| 5,585,215 | A | 12/1996 | Ong et al. |
| 5,585,460 | A | 12/1996 | Yamada et al. |
| 5,601,960 | A | 2/1997 | Mahabadi et al. |
| 5,621,022 | A | 4/1997 | Jaeger et al. |
| 5,629,121 | A | 5/1997 | Nakayama |
| 5,650,255 | A | 7/1997 | Ng et al. |
| 5,650,256 | A | 7/1997 | Veregin et al. |
| 5,650,484 | A | 7/1997 | Hawkins et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,750,909 | A | 5/1998 | Hawkins et al. |
| 5,756,657 | A | 5/1998 | Sawan et al. |
| 5,763,133 | A | 6/1998 | Ong et al. |
| 5,766,818 | A | 6/1998 | Smith et al. |

(Continued)

FOREIGN PATENT DOCUMENTS

| | | | |
|---|---|---|---|
| EP | 0 464 829 | A1 | 1/1992 |
| WO | WO 2006129681 | A1 * | 12/2006 |

OTHER PUBLICATIONS

The English translation of WO20060129681A1 is provided in US 20090305158.*

European Search Report for European Application No. 10167051.1, mailed Sep. 29, 2010.

*Primary Examiner* — Mark F Huff

*Assistant Examiner* — Stewart Fraser

(74) *Attorney, Agent, or Firm* — Oliff & Berridge, PLC

(57) ABSTRACT

A toner that includes at least one polyester resin wherein the amount of free polyvalent acid monomer in the polyester resin is less than 4 mg/gram, and wherein the percentage of the at least one polyester resin with a $M_W$ less than 1500 is less than about 10%.

19 Claims, No Drawings

U.S. PATENT DOCUMENTS 5,780,520 A 7/1998 Reeves et al.
5,804,349 A 9/1998 Ong et al.
5,827,633 A 10/1998 Ong et al.
5,830,979 A 11/1998 Nakayama et al.
5,840,462 A 11/1998 Foucher et al.
5,853,944 A 12/1998 Foucher et al.
5,869,215 A 2/1999 Ong et al.
5,902,709 A 5/1999 Nakayama et al.
5,916,725 A 6/1999 Patel et al.
6,087,471 A 7/2000 Kurdikar et al.
6,103,774 A 8/2000 Rule
6,120,967 A 9/2000 Hopper et al.
6,221,137 B1 4/2001 King et al.
6,241,828 B1 6/2001 Barnes
6,326,119 B1 12/2001 Hollenbaugh, Jr. et al.
6,335,139 B1 1/2002 Gambayashi et al.
6,358,657 B1 3/2002 Silence et al.
6,359,105 B1 3/2002 Ianni et al.
6,365,316 B1 4/2002 Stamp et al.
6,369,192 B1 4/2002 Dufresne et al.
6,383,705 B2 5/2002 Aoki et al.
6,472,523 B1 10/2002 Banning et al.
6,476,219 B1 11/2002 Duff et al.
6,576,747 B1 6/2003 Carlini et al.
6,576,748 B1 6/2003 Carlini et al.
6,590,082 B1 7/2003 Banning et al.
6,592,913 B2 7/2003 Cook et al.
6,593,053 B1 7/2003 Chang et al.
6,646,111 B1 11/2003 Carlini et al.
6,663,703 B1 12/2003 Wu et al.
6,673,139 B1 1/2004 Wu et al.
6,696,552 B2 2/2004 Mayo et al.
6,713,614 B2 3/2004 Carlini et al.
6,726,755 B2 4/2004 Titterington et al.
6,755,902 B2 6/2004 Banning et al.
6,780,557 B2 8/2004 Kawaji et al.
6,821,327 B2 11/2004 Jaeger et al.
6,942,951 B2 9/2005 Daimon et al.
6,958,406 B2 10/2005 Banning et al.
7,053,227 B2 5/2006 Jaeger et al.
7,056,635 B2 6/2006 Tanaka et al.
7,235,337 B2 * 6/2007 Kameyama et al. ..... 430/108.23
7,329,476 B2 2/2008 Sacripante et al.
7,368,213 B2 5/2008 Nakayama et al.
7,381,831 B1 6/2008 Banning et al.
7,427,323 B1 9/2008 Birau et al.
2001/0046636 A1 11/2001 Daimon et al.
2003/0054280 A1 * 3/2003 Ishihara et al. ..... 430/124
2006/0216626 A1 9/2006 Sacripante et al.
2007/0248903 A1 10/2007 Nakagawa
2008/0107990 A1 5/2008 Field et al.
2008/0236446 A1 10/2008 Zhou et al.
2009/0047593 A1 2/2009 Vanbesien et al.
2009/0305158 A1 * 12/2009 Ono et al. ..... 430/109.4
2010/0136472 A1 * 6/2010 McDougall et al. ..... 430/109.4

* cited by examiner

PURIFIED POLYESTER RESINS FOR TONER PERFORMANCE IMPROVEMENT

BACKGROUND

This present disclosure relates to toners and developers containing the toners for use in forming and developing images, and in particular to toners formed using purified polyester resins. The disclosure also relates to processes for producing and using such toners and developers.

In electrophotographic printing processes, a photoreceptor containing a photoconductive insulating layer on a conductive layer is imaged by uniformly and electrostatically charging the surface of the conductive layer. By exposing the photoreceptor to a pattern of activating electromagnetic radiation, such as light, the radiation selectively dissipates the charge in illuminated areas of the photoconductive insulating layer, while an electrostatic latent image is formed on the non-illuminated areas. Toner particles are attracted from carrier granules to the latent image to develop the latent toner image. The toner image is then transferred from the photoconductive surface to a sheet and fused onto the sheet.

Various toner compositions for such a printing system have been produced using a wide array of additives and constituent materials. Generally, toner particle compositions include a binding material, such as a resin, and any of various additives, such as colorants and waxes, to provide particular properties to the toner particles.

Numerous devices and processes are used to prepare toner particles. Examples of commercially known processes include the melt-blending of toner components in a Banbury roll mill apparatus, spray drying, dispersion polymerization, solution polymerization, and the like. An additional device and process that may be used to prepare toner compositions is a melt extrusion apparatus and process, which possesses a number of advantages over a Banbury roll mill apparatus and process. For example, melt extrusion is a continuous process, rather than a batch process, and extrusion processes can be easily automated, allowing for more economical toner preparation. Examples of conventional toners produced via melt extrusion are described, for example, in U.S. Pat. Nos. 4,894,308, 4,973,439, 5,145,762, 5,227,460, 5,376,494 and 5,468,586, the entire disclosures of which are incorporated herein by reference.

Emulsion aggregation toners are also excellent toners to use in forming print and/or xerographic images in that the toners can be made to have uniform sizes and in that the toners are environmentally friendly. U.S. patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215, the entire disclosures of which are incorporated herein by reference.

Emulsion aggregation techniques typically involve the formation of an emulsion latex of the resin particles, which particles have a small size of from, for example, about 5 to about 500 nanometers in diameter, by heating the resin, optionally with solvent if needed, in water or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are heated to enable coalescence/fusing, thereby achieving aggregated, fused toner particles.

Two main types of emulsion aggregation toners are known. First is an emulsion aggregation process that forms acrylate based, for example, styrene acrylate, toner particles. See, for example, U.S. Pat. No. 6,120,967, the entire disclosure of which is incorporated herein by reference, as one example of such a process. Second is an emulsion aggregation (EA) process that forms polyester, for example, sodio sulfonated polyester, toner particles. See, for example, U.S. Pat. No. 5,916,725, the entire disclosure of which is incorporated herein by reference, as one example of such a process. Alternatively, toner particles can be formed via an EA process that uses preformed polyester latex emulsions made using solvent flash or phase inversion emulsification such as those toner methods described in U.S. Patent Application Publication No. 2008/0236446, the entire disclosure of which is incorporated herein by reference. Additionally, so-called ultra low melt polyester toners can be obtained by incorporation of a suitable crystalline polyester. Examples of EA ultra low melt (ULM) polyester toners, such as those described in U.S. Pat. Nos. 5,057,392, 5,147,747, 6,383,705, 6,780,557, 6,942,951, 7,056,635 and U.S. Patent Application Pub. No. 2008/0236446, the disclosures of which are incorporated by reference in their entirety.

Polyester-based toners (both conventionally extruded and emulsion aggregation based) have recently begun to replace styrene-acrylate toners due to the lower achievable minimum fixing temperatures (MFT) of polyester-based toners. Lower MFT toners provide the opportunity for higher print productivity and/or reduced fusing temperatures, and therefore lower printer power consumption. Polyesters may be prepared via step-growth polycondensation of di-acid and diol. To obtain a high molecular weight polyester from such a polycondensation reaction typically requires high temperature and vacuum removal of the alcoholic by-products. As the molecular weight of the polyester increases, the viscosity also increases dramatically. This viscosity increase can result in imprecise process control, and as a result, the polyester typically has a broad molecular weight distribution. Examples of ultra low melt (ULM) toners, such as those described in U.S. Pat. Nos. 4,246,332, 4,980,448, 5,156,937, 5,202,212, 5,830,979, 5,902,709 and 6,335,139, and U.S. Patent Application Pub. No. 2007/0248903, the disclosures of which are incorporated by reference in their entirety, are prepared by numerous methods.

While toners comprised of these resins may exhibit excellent fusing properties including lower crease MFT and broader fusing latitude, problems such as poor toner flow, relatively low toner blocking temperatures, high triboelectric charging sensitivity with respect to changes in humidity and poor printer fuser life may still exist. The present inventors believe these problems may be due to the presence of a large amount of low molecular weight materials present in the polyester resin. The low molecular weight materials of the polyester resin are typically comprised of di-acid and dihydroxyl monomers and short chain-length oligomers of these monomers. These low molecular weight materials typically are relatively volatile at the high temperature conditions associated with the fuser and thus may lead to undesirable chemical reactions occurring in-situ in the fusing apparatus. For example, during image fixing at high temperature conditions, the free polyvalent acid monomers (the unpolymerized monomer species) can react with the fuser oil and/or certain additives within the toner to produce contaminants that can deposit on the fuser roll, such as zinc salt contaminants. The buildup of these contaminants signficantly reduces the number of defect-free prints a xerographic device can output before replacement of the fuser roll is required. The inventors further believe problems, such as as poor toner flow and blocking, may be associated with the propensity of the contaminants to plasticize the toner particle and therefore result in a lowering in the Tg (glass transition temperature) of the toner. Further, the presence of low molecular weight acid monomers and oligomers are believed to result in an increased propensity to absorb moisture and therefore affect the variable charging performance as a function of the ambient humidity level.

SUMMARY

What is still desired is a toner with reduced amount of low molecular weight materials and yet result in a minimal change in the remaining molecular weight profile of the resin, which would provide multiple advantages such as more stable triboelectric charging, improved toner flow, reduced relative humidity sensitivity and a reduction in the buildup of zinc salt contaminants on the fuser roll. Such a toner would thus be suitable for all processes and/or devices using a toner.

The above and other issues are addressed by the present application, wherein in embodiments, the application relates to a toner comprising: at least one polyester resin, wherein the amount of free polyvalent acid monomer in the at least one polyester resin is less than 4 mg/gram, and wherein a percentage of polyester resin with a $M_w$ less than 1500 in the at least one polyester resin is less than about 10% of total resin content in the toner.

In embodiments, described is a toner comprising: at least one polyester resin, and at least one high molecular weight polyester resin having a $M_w$ greater than about 15,000 and a polydispersity index greater than 4, and wherein the amount of free polyvalent acid monomer in the toner is less than 4 mg/gram, and wherein a percentage of polyester resin with a $M_w$ less than 1,500 in the polyester resin and high molecular weight polyester resin is less than about 10% of total resin content in the toner.

In further embodiments, described is a method forming a toner comprised of at least one polyester resin, the method comprising: dissolving at least one polyester resin to be used in forming the toner in a first solvent, precipitating the at least one polyester resin out of the first solvent using a second solvent that is different from the first solvent, wherein the dissolving and precipitating reduces the acid number of the at least one polyester resin from 4 to 8 units to form at least one purified polyester resin, wherein an amount of free polyvalent acid monomer in the at least one purified polyester resin is less than 4 mg/gram and a percentage of polyester resin with a $M_w$ less than 1500 in the at least one purified polyester resin is less than about 10% of total resin content in the toner, and processing the at least one purified polyester resin into a toner particle.

EMBODIMENTS

Described herein is a toner comprising: at least one polyester resin, wherein the amount of free polyvalent acid monomer in the polyester resin is less than 4 mg/gram, and wherein the percentage of the at least one polyester resin with a $M_w$ less than 1500 is less than about 10%. The toner particles may be formed via the steps of melt-extrusion, grinding/pulverization and classification or formed via a chemical toner process such as the emulsion aggregation process, and may possess a core-shell configuration, with an amorphous polyester resin, a crystalline polyester resin or a high-molecular weight polyester resin in the core, shell, or both.

The specific polyester resin or resins selected for the present disclosure include, for example, saturated and unsaturated polyester resins and/or its derivatives, including polyester resins and branched polyester resins, in situ formed crosslinked polyester resins, alkali sulfonated-polyester resins, branched alkali sulfonated-polyester resins, crystalline polyester resins and amorphous polyester resins.

Illustrative examples of polyester resins selected for the process and particles of the present disclosure include any of the various polyesters, such as crystalline polyesters, linear and/or branched amorphous polyesters, crosslinked polyesters formed in situ from said linear and/or branched amorphous polyesters, or a mixture thereof. Crystalline polyesters include saturated or unsaturated polyesters, or mixtures thereof. Linear and/or branched amorphous polyesters include unsaturated polyesters, and optionally saturated polyesters. Thus, for example, the toner particles can be comprised of crystalline polyester resins, amorphous polyester resins, or a mixture of two or more polyester resins where one or more polyester is crystalline and one or more polyester is amorphous.

In embodiments, the polyester resin may be a crystalline resin. As used herein, "crystalline" refers to a polyester with a three dimensional order. "Semicrystalline resins" as used herein refer to resins with a crystalline percentage of, for example, from about 10 to about 60%, and more specifically from about 12 to about 50. Further, as used hereinafter "crystalline polyester resins" and "crystalline resins" encompass both crystalline resins and semicrystalline resins, unless otherwise specified.

Illustrative examples of crystalline polyester resins may include any of the various crystalline polyesters, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly(pentylene-dodecanedioate), poly(hexylene-dodecanedioate), poly(octylene-dodecanedioate), poly(nonylene-dodecanedioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate) and combinations thereof.

The crystalline polyester resins, which are available from a number of sources, can possess various melting points of, for example, from about 30° C. to about 120° C., such as from about 50° C. to about 90° C. The crystalline resin may have, for example, a number average molecular weight ($M_n$), as measured by gel permeation chromatography (GPC) of, for example, from about 1,000 to about 50,000, and preferably from about 2,000 to about 25,000. The weight average molecular weight ($M_w$) of the resin may be, for example, from about 2,000 to about 100,000, and preferably from about 3,000 to about 80,000, as determined by GPC using polystyrene standards. The molecular weight distribution ($M_w/M_n$) of the crystalline resin is, for example, from about 2 to about 6, and more specifically, from about 2 to about 4.

The crystalline resins can be prepared by a polycondensation process by reacting suitable organic diol(s) and suitable organic diacid(s) in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof, and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

Suitable crystalline polyester resins include those disclosed in U.S. Pat. No. 7,329,476 and U.S. Patent Application Pub. Nos. 2006/0216626, 2008/0107990, 2008/0236446 and 2009/0047593, each of which is hereby incorporated by reference in their entirety. In embodiments, a suitable crystalline resin may include a resin composed of ethylene glycol and a mixture of dodecanedioic acid and fumaric acid co-monomers with the following formula:

(I)

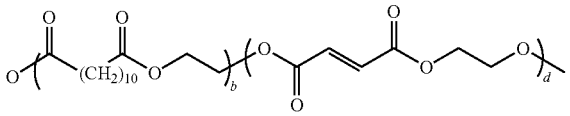

wherein b is from 5 to 2000 and d is from 5 to 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly (decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene tritbiodicarboxylate), poly(trimethylene dodecane dioate), poly(m-xylene), poly(p-xylylene pimelamide), and combinations thereof.

The polyester resin may also be a linear amorphous polyester resin. Examples of the linear amorphous polyester resins include poly(propoxylated bisphenol A co-fumarate), poly (ethoxylated bisphenol A co-fumarate), poly(butyloxylated bisphenol A co-fumarate), poly(co-propoxylated bisphenol A co-ethoxylated bisphenol A co-fumarate), poly(1,2-propylene fumarate), poly(propoxylated bisphenol A co-maleate), poly(ethoxylated bisphenol A co-maleate), poly(butyloxylated bisphenol A co-maleate), poly(co-propoxylated bisphenol A co-ethoxylated bisphenol A co-maleate), poly(l,2-propylene maleate), poly(propoxylated bisphenol A co-itaconate), poly(ethoxylated bisphenol A co-itaconate), poly(butyloxylated bisphenol A co-itaconate), poly(co-propoxylated bisphenol A co-ethoxylated bisphenol A co-itaconate), poly(1,2-propylene itaconate), and combinations thereof.

In embodiments, a suitable linear amorphous polyester resin may be a poly(propoxylated bisphenol A co-fumarate) resin having the following formula (I):

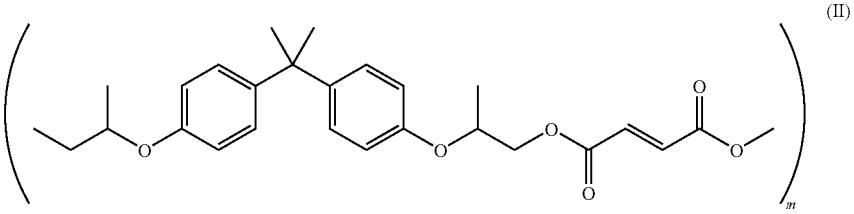

(II)

wherein m may be from about 5 to about 1000.

An example of a linear propoxylated bisphenol A fumarate resin which may be utilized as a latex resin is available under the trade name SPARII™ from Resana S/A Industrias Quimicas, Sao Paulo Brazil. Other suitable linear resins include those disclosed in U.S. Pat. Nos. 4,533,614, 4,957,774 and 4,533,614, which can be linear polyester resins including dodecylsuccinic anhydride, terephthalic acid, and alkyloxylated bisphenol A. Other propoxylated bisphenol A terephthalate resins that may be utilized and are commercially available include GTU-FC115, commercially available from Kao Corporation, Japan, and the like.

In embodiments, the polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-isophthalate, polypropylene-isophthalate, polybutylene-isophthalate, polypentylene-isophthalate, polyhexalene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(ethoxylated bisphenol A-fumarate), poly(ethoxylated bisphenol A-succinate), poly (ethoxylated bisphenol A-adipate), poly(ethoxylated bisphenol A-glutarate), poly(ethoxylated bisphenol A-terephthalate), poly(ethoxylated bisphenol A-isophthalate), poly (ethoxylated bisphenol A-dodecenylsuccinate), poly (propoxylated bisphenol A-fumarate), poly(propoxylated bisphenol A-succinate), poly(propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), LETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof The resins can also be functionalized, such as carboxylated, sulfonated, or the like, and particularly such as sodio sulfonated, if desired.

The amorphous resins, linear or branched, which are available from a number of sources, can possess various onset glass transition temperatures (Tg) of, for example, from about 40° C. to about 80° C., such as from about 50° C. to about 70° C. as measured by differential scanning calorimetry (DSC). The linear and branched amorphous polyester resins, in embodiments, may be a saturated or unsaturated resin.

The linear amorphous polyester resins are generally prepared by the polycondensation of an organic diol, a diacid or diester, and a polycondensation catalyst. The amorphous resin is generally present in the toner composition in various suitable amounts, such as from about 60 to about 90 weight percent, or from about 50 to about 65 weight percent, of the toner or of the solids.

Examples of diacid or diesters selected for the preparation of amorphous polyesters include dicarboxylic acids or diesters selected from the group consisting of terephthalic acid, phthalic acid, isophthalic acid, fumaric acid, malic acid, itaconic acid, succinic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfimarate, dimethylmaleate, dimethylglutarate, dimethyladipate, dimethyl dodecylsuccinate, dimethyl dodecenylsuccinate, and mixtures thereof. The organic diacid or diester is selected, for example, from about 45 to about 52 mole percent of the resin. Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and mixtures thereof. The amount of organic diol selected can vary, and more specifically, is, for example, from about 45 to about 52 mole percent of the resin.

Examples of suitable polycondensation catalyst for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof, and which catalysts are selected in amounts of, for example, from about 0.01 mole percent to about 5 mole percent based on the starting diacid or diester used to generate the polyester resin.

The crystalline polyester resin or amorphous polyester resin may be a branched resin. As used herein, the terms "branched" or "branching" includes branched resin and/or cross-linked resins. Branching agents for use in forming these branched resins include, for example, a multivalent polyacid such as 1 ,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Linear or branched unsaturated polyesters selected for the in situ preparation of the crosslinked polyester particles and process of the present disclosure include low molecular weight condensation polyesters which may be formed by the step-wise reactions between both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins useful are prepared by melt polycondensation or other polymerization processes using diacids and/or anhydrides and diols.

In embodiments, the amorphous resin or combination of amorphous resins utilized in the core may have a glass transition temperature of from about 30° C. to about 80° C., in embodiments from about 35° C. to about 70° C. In further embodiments, the combined resins utilized in the core may have a melt viscosity of from about 10 to about 1,000,000 Pa*S at about 130° C., in embodiments from about 50 to about 100,000 Pa*S.

The monomers used in making the selected polyester resin are not limited, and the monomers utilized may include any one or more of, for example, ethylene, propylene, and the like. Known chain transfer agents, for example dodecanethiol or carbon tetrabromide, can be utilized to control the molecular weight properties of the polyester. Any suitable method for forming the polyester from the monomers may be used without restriction.

The polyester resin may be present in an amount of from about 65 to about 95 percent by weight, such as about 75 to about 85 percent by weight, of the toner particles (that is, toner particles exclusive of external additives) on a solids basis. The ratio of crystalline resin to amorphous resin can be in the range from about 1:99 to about 30:70, such as from about 5:95 to about 25:75. However, amounts and ratios outside of these ranges can be used, in embodiments, depending upon the type and amounts of other materials present.

One, two, or more polyester resins may be used. In embodiments where two or more toner resins are used, the toner resins may be in any suitable ratio (for example weight ratio) such as for instance about 10% (first resin)/90% (second resin) to about 90% (first resin)/10% (second resin).

In embodiments, the resins described above may be combined with a high molecular weight branched or cross-linked resin. This high molecular weight resin may include, in embodiments, for example, a branched resin or polyester, a cross-linked resin or polyester, or mixtures thereof, or a non-cross-linked resin that has been subjected to cross-linking. In accordance with the present disclosure, from about 1% by weight to about 100% by weight of the high molecular weight resin may be branched or cross-linked, in embodiments from about 2% by weight to about 50% by weight of the higher molecular weight resin may be branched or cross-linked. As used herein, the term "high molecular weight resin" refers to a resin wherein the weight-average molecular weight ($M_w$) of the chloroform-solule fraction of the resin is above about 15,000 and the polydispersity index (PD) is above about 4, as measured by gel permeation chromatography versus standard polystyrene reference resins. The PD index is the ratio of the weight-average molecular weight ($M_w$) and the number-average molecular weight ($M_n$).

The high molecular weight polyester resins may prepared by branching or cross-linking linear polyester resins. Branching agents can be utilized, such as trifunctional or multifunctional monomers, which agents usually increase the molecular weight and polydispersity of the polyester. Suitable branching agents include glycerol, trimethylol ethane, trimethylol propane, pentaerythritol, sorbitol, diglycerol, trimellitic acid, trimellitic anhydride, pyromellitic acid, pyromellitic anhydride, 1,2,4-cyclohexanetricarboxylic acid, 2,5,7-naphthalenetricarboxylic acid, 1,2,4-butanetricarboxylic acid, combinations thereof, and the like. These branching agents can be utilized in effective amounts of from about 0.1 mole percent to about 20 mole percent based on the starting diacid or diester used to make the resin.

Compositions containing modified polyester resins with a polybasic carboxylic acid which may be utilized in forming high molecular weight polyester resins include those disclosed in U.S. Pat. No. 3,681,106, as well as branched or cross-linked polyesters derived from polyvalent acids or alcohols as illustrated in U.S, Pat. Nos. 4,863,825; 4,863,824; 4,845,006; 5,143,809; 5,057,596; 4,988,794; 4,981,939; 4,980,448; 4,933,252; 4,931,370; 4,917,983 and 4,973,539, the disclosures of each of which are incorporated by reference herein in their entirety.

In embodiments, cross-linked polyesters resins may be made from linear polyester resins that contain sites of unsaturation that can react under free-radical conditions. Examples of such resins include those disclosed in U.S. Pat. Nos. 5,227,460; 5,376,494; 5,480,756; 5,500,324; 5,601,960; 5,629,121; 5,650,484; 5,750,909; 6,326,119; 6,358,657; 6,359,105; and 6,593,053, the disclosures of each of which are incorporated by reference in their entirety. In embodiments, suitable unsaturated polyester base resins may be prepared from diacids and/or anhydrides such as, for example, maleic anhydride, fumaric acid, and the like, and combinations thereof, and diols such as, for example, ethoxylated bisphenol A, propoxylated bisphenol A, propylene glycol, and the like, and combinations thereof. In embodiments, a suitable polyester is poly(propoxylated bisphenol A fumarate).

In embodiments, the high molecular weight branched or cross-linked polyester resin has a $M_w$ of greater than about 15,000, in embodiments from about 15,000 to about 1,000,000, in other embodiments from about 20,000 to about 100,000, and a polydispersity index ($M_w/M_n$) of greater than about 4, in embodiments from about 4 to about 100, in other embodiments from about 6 to about 50, as measured by GPC versus standard polystyrene reference resins.

In embodiments, a cross-linked branched polyester may be utilized as a high molecular weight resin. Such polyester resins may be formed from at least two pre-gel compositions including at least one polyol having two or more hydroxyl groups or esters thereof, at least one aliphatic or aromatic polyfunctional acid or ester thereof, or a mixture thereof having at least three functional groups; and optionally at least one long chain aliphatic carboxylic acid or ester thereof or aromatic monocarboxylic acid or ester thereof, or mixtures thereof. The two components may be reacted to substantial completion in separate reactors to produce, in a first reactor, a first composition including a pre-gel having carboxyl end groups, and in a second reactor, a second composition including a pre-gel having hydroxyl end groups. The two compositions may then be mixed to create a cross-linked branched polyester high molecular weight resin. Examples of such polyesters and methods for their synthesis include those disclosed in U.S. Pat. No. 6,592,913, the disclosure of which is hereby incorporated by reference in its entirety.

In embodiments, the cross-linked branched polyesters for the high molecular weight resin may include those resulting from the reaction of dimethylterephthalate, 1,3-butanediol, 1,2-propanediol, and pentaerythritol.

Suitable polyols may contain from about 2 to about 100 carbon atoms and have at least two or more hydroxy groups, or esters thereof. Polyols may include glycerol, pentaerythritol, polyglycol, polyglycerol, and the like, or mixtures thereof. The polyol may include a glycerol. Suitable esters of glycerol include glycerol palmitate, glycerol sebacate, glycerol adipate, triacetin tripropionin, and the like. The polyol may be present in an amount of from about 20% to about 30% weight of the reaction mixture, in embodiments, from about 20% to about 26% weight of the reaction mixture.

Aliphatic polyfunctional acids having at least two functional groups may include saturated and unsaturated acids containing from about 2 to about 100 carbon atoms, or esters thereof, in some embodiments, from about 4 to about 20 carbon atoms. Other aliphatic polyfunctional acids include malonic, succinic, tartaric, malic, citric, fumaric, glutaric, adipic, pimelic, sebacic, suberic, azelaic, sebacic, and the like, or mixtures thereof. Other aliphatic polyfunctional acids which may be utilized include dicarboxylic acids containing a $C_3$ to $C_6$ cyclic structure and positional isomers thereof, and include cyclohexane dicarboxylic acid, cyclobutane dicarboxylic acid or cyclopropane dicarboxylic acid.

Aromatic polyfunctional acids having at least two functional groups which may be utilized include terephthalic, isophthalic, trimellitic, pyromellitic and naphthalene 1,4-, 2,3-, and 2,6-dicarboxylic acids.

The aliphatic polyfunctional acid or aromatic polyfunctional acid may be present in an amount of from about 40% to about 65% weight of the reaction mixture, in embodiments, from about 44% to about 60% weight of the reaction mixture.

Long chain aliphatic carboxylic acids or aromatic monocarboxylic acids may include those containing from about 12 to about 26 carbon atoms, or esters thereof, in embodiments, from about 14 to about 18 carbon atoms. Long chain aliphatic carboxylic acids may be saturated or unsaturated. Suitable saturated long chain aliphatic carboxylic acids may include lauric, myristic, palmitic, stearic, arachidic, cerotic, and the like, or combinations thereof. Suitable unsaturated long chain aliphatic carboxylic acids may include dodecylenic, palmitoleic, oleic, linoleic, linolenic, erucic, and the like, or combinations thereof Aromatic monocarboxylic acids may include benzoic, naphthoic, and substituted napthoic acids. Suitable substituted naphthoic acids may include naphthoic acids substituted with linear or branched alkyl groups containing from about 1 to about 6 carbon atoms such as 1-methyl-2 naphthoic acid and/or 2-isopropyl-1-naphthoic acid. The long chain aliphatic carboxylic acid or aromatic monocarboxylic acids may be present in an amount of from about 0% to about 70% weight of the reaction mixture, in embodiments, of from about 15% to about 30% weight of the reaction mixture.

Additional polyols, ionic species, oligomers, or derivatives thereof, may be used if desired. These additional glycols or polyols may be present in amounts of from about 0% to about 50% weight percent of the reaction mixture. Additional polyols or their derivatives thereof may include propylene glycol, 1,3-butanediol, 1,3-propanediol, 1,4-butanediol, 1,6-hexanediol diethylene glycol, 1,4-cyclohexanediol, 1,4-cyclohexanedimethanol, neopentyl glycol, triacetin, trimethylolpropane, pentaerythritol, cellulose ethers, cellulose esters, such as cellulose acetate, sucrose acetate iso-butyrate and the like.

The amount of high molecular weight resin in a toner particle of the present disclosure, whether in the core, the shell, or both, may be from about 1% to about 30% by weight of the toner, in embodiments from about 2.5% to about 20% by weight, or from about 5% to about 10% by weight of the toner.

In embodiments, the high molecular weight resin, for example a branched polyester, may be present on the surface of toner particles of the present disclosure. The high molecular weight resin on the surface of the toner particles may also be particulate in nature, with high molecular weight resin particles having a diameter of from about 100 nanometers to about 300 nanometers, in embodiments from about 10 nanometers to about 150 nanometers. The high molecular weight resin particles may cover from about 10% to about 90% of the toner surface, in embodiments from about 20% to about 50% of the toner surface.

In embodiments, resins which may be utilized to form a shell include the high molecular weight resin described above, and/or the amorphous polyester resins and crystalline polyester resins described above for use as the core. In embodiments, an amorphous or crystalline resin that may be utilized to form a shell in accordance with the present disclosure includes an amorphous polyester, optionally in combination with a high molecular weight resin latex described above. Multiple polyester resins may be combined together as a binder for the toner particles and may be utilized in any suitable amounts. In embodiments, a first amorphous polyester resin may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

In embodiments, prior to being included in a toner, each of the above polyester resins (polyester resin and/or high-molecular weight polyester resin) is subjected to a purification process. This process is intended to remove low molecular weight components from the resin, such as low molecular weight polyester resins, unreacted monomers (diol or diacid). Further, this process may be performed after the the resins are formed by suitable methods or on commercially obtained polyester resins and high-molecular weight polyester resins. This purification process is comprised of dissolving the at least one of the above polyester resins in a first solvent with or without heat, and precipitating these resins out of the first solvent using a second solvent that is different from the first solvent and in which the polyester resin(s) are less soluble. The precipitated resin may then be collected by decantation or filtration with any additional solvents being removed under a vacuum. Other examples of purification processes include those processes described in U.S. Pat. Nos. 4,810,775, 5,004,664 and 4,523,591, each of which is incorporated by reference herein in their entirety.

Although the purification process described herein may be performed at room temperature, an elevated process temperature can be also used for this process to decrease the time required to dissolve the resin. Should the resin be dissolved at an elevated temperature, the process temperature should not be higher than the boiling point(s) of the solvent(s). During the precipitation step, a lower process temperature may be used to accelerate this process, but lower temperatures can lead to higher solution viscosities and thus result in process issues. Thus, the process may be performed at a temperature from about 5° C. to about 60° C.

The process time depends on the combination of the choice of solvents, toner resin properties and mixing efficiency during processing, and therefore it would be improper to define a process time range in general. If the toner binder includes a mixture of the polyester resins, the above purification process may be performed on each polyester resin of the mixture individually or on the mixture of polyester resins.

Examples of various dissolution processes are described in U.S. Pat. Nos. 2,762,788, 3,935,169, 4,064,079, 4,591,629, 5,049,647, 5,478,921, 5,585,460, 5,756,657, 5,780,520, 6,087,471, 6,103,774, 6,241,828, 6,369,192, and 7,368,213, each of which is incorporated by reference in their entirety. The selection of the first and second solvent is based upon the solubility parameter (SP) of the respective solvent. As used herein, an SP value means a value obtained by reference to solubility parameter values shown starting on page IV-341 of the Polymer Handbook, $2^{nd}$ Edition (J. Brandrup and E. H. Immergut, Wiley Interscience) or by use of Fedors' method. The S P value may be defined by the following equation:

$$SP = \sqrt{\frac{\Delta E}{V}} = \sqrt{\frac{\sum_i \Delta ei}{\sum_i \Delta vi}}$$

In the equation, SP represents a solubility parameter, ΔE represents a cohesive energy (cal/mol), V represents mole volume ($cm^3$/mol), Δei represents a vaporization energy of an $i^{th}$ atom or atomic moiety (cal/atom or atomic moiety), Δvi represents a mole volume of an $i^{th}$ atom or atomic moiety ($cm^3$/atom or atomic moiety), and i represents an integer of 1 or more, The solubility parameter of the first solvent may be from about 8.0 to about 11.5, such as, for example, from about 8.5 to about 10, from about 8.75 to about 9.75 and from about 9.00 to about 9.50. The solubility of the second solvent may be below or above, but may not fall within, the above range for the first solvent. Examples of first solvent and second solvent pairs can include acetone (9.8)/methanol (14.5); methyl ethyl ketone (9.3)/ethyl alcohol (12.7); toluene (8.9)/benzyl alcohol (12.1); tetrahydrofuran (9.1)/dodecane (7.9); methylene chloride (9.7)/diethyl ether (7.4); methyl n-butyl ketone (8.3)/ethylene glycol (14.6); dimethyl phthalate (10.7)/propyl alcohol (11.9) and N-methyl pyrrolidone (11.3)/water (23.4). Other examples may include a multi-solvent system such as acetone (9.8)/methanol (14.5)/water (23.4); tetrahydrofuran (9.1)/methyl ethyl ketone (9.3)/diethyl ether (7.4). Thus, the first and second solvents could be a mixture of solvents such that the weighted average of the combined solubility parameters are as defined above.

As discussed above, the above polyester toners and/or high-molecular weight polyester toners may be grown via step-growth polycondensation of a di-acid or a diol to form either amorphous or crystalline polyester resins. However, the monomeric species used to form these polyester toners do not attach themselves to other monomeric species in uniform amounts. As such, polyester toners are comprised of polymeric species with varying molecular weights, often categorized as "low molecular weight species" and "high molecular weight species". The breakdown between the "low molecular weight species" and the "high molecular weight species" is typically associated with the weight average molecular weight value ($M_w$). As used herein, the phrase "low molecular weight species" refers to species of the above polyester resins with a $M_w$ less than 1500, such as for example, less than about 1000, less than about 750, less than about 600 or less than about 500.

Toners containing these low molecular weight species typically show poor powder flow, unstable triboelectric charge and a high relative humidity sensitivity, particularly in the A-zone (80° C., 80% RH). The low molecular weight oligomers also tend to result in increased cost of ownership for printers due to a reduction in the average useful life of the fuser.

The above purification process thus reduces the amount of low molecular weight species and the acid number of the above polyester resins. For example, the percentage of polyester resin with a M, less than 1500 in the above polyester resins and/or high-molecular weight polyester resin may be less than about 10% of total resin content in the toner, less than about 7.5% of total resin content in the toner and less than about 5% of total resin content in the toner. The acid number is determined by titrating one gram of the polyester resin dissolved in a toluene/methanol solvent mixture with a base, such as potassium hydroxide or sodium hydroxide with a normality of about 0.1 N. The above process may reduce the acid number of the polyester resin from 4 to about 8 units such as from 4 to 6 units and thus result in a reduction of the acid number from about 15 to about 35%, from about 20 to about 30% and from about 25 to about 30% as compared to a resin not purified by the above process. Removal of low molecular weight acid components is believed to obtain reduced charging humidity sensitivity since it is these low molecular weight species that are relatively hygroscopic. The removal of these species reduces the toner's ability to absorb water and as a result, the toners are able to maintain suitable triboelectrification performance in spite of being exposed to high temperature, high humidity conditions (the A-zone). Additionally, because removal of the low molecular weight species has little impact on the charging properties under nominal and dry conditions, toner charging performance is more uniform over the full range of typical environmental conditions.

Furthermore, the above purification process also reduces the amount of the free polyvalent acid monomer in the polyester resin and/or high-molecular weight polyester resin. As discussed above, the low molecular weight portion a polyester resin contains a diacid component. However, even under optimum polymerization conditions, a small amount of diacid monomer is not incorporated into the polyester, and remains as a free acid monomer contaminant in the polyester resin. This contaminant is referred to herein as the free polyvalent acid monomer. The acid or diacid component of the free polyvalent acid monomer may be selected from the group consisting of terephthalic acid, phthalic acid, isophthalic acid, fumaric acid, maleic acid, itaconic acid, succinic acid, dodecylsuccinic acid, glutaric acid, adipic acid, pimelic acid, suberic acid, azelic acid, dodecanediacid, oxalic acid, naphthalene-2,6-dicarboxylic acid, naphthalene-2,7-dicarboxylic acid, cyclohexane dicarboxylic acid, malonic acid, mesaconic acid, and mixtures thereof.

Fuser rolls are typically formulated out of low surface energy elastomers specifically to reduce the tendency for materials to stick to the surface of the roll. As toner comes into contact with the fuser roll, the free polyvalent acid monomer reacts with various toner and/or paper additives, such as, for example, zinc stearate to form a zinc salt contaminant, which has been associated with the formation of undesirable axial gloss line defects on the final prints. As used herein, the phrase "axial gloss lines" refers to lines that extend along the axial direction of the paper reducing the overall image quality of the print, and are especially evident within high density, solid area parts of a high quality and high resolution pictorial images. However, the above purification process reduces the amount of free polyvalent acid monomers in the resin composition and therefore leads to a dramatic reduction in the formation of this particular type of gloss defect. For example, the amount of the free polyvalent acid monomer in the polyester resin may less than 4 mg/gram of resin, less than 3,5 mg/g of resin, less than 2.5 mg/g of resin, less than 1.0 mg/g of resin, less than 0.1 mg/g of resin or less than 0.01 mg/g of resin. The amount of the free polyvalent acid monomer may be determined by quantification against known standards by Ion Chromatography or by identification and quantification by standard Nuclear Magnetic Resonance (NMR) spectroscopic methods.

The present inventors further believe that the presence of such zinc salt contaminants could also increase the surface energy of the fuser roll and thus increase the tendency for all types of polar contaminants (for example, gelled fuser oil, paper dust, toner resin and the like) to build up on the fuser roll surface.

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

The resulting toner particles can possess an average volume particle diameter of about 2 to about 25 microns, and may be from about 3 to about 15 microns, or from about 5 microns. In embodiments, the particles may have a geometric size distribution (GSD) of about 1.40 of less. In other embodiments, the toner particles have a GSD of about 1.25 or less, and, in further embodiments, the GSD may be less than about 1.23. In still other embodiments, the particles have a size of about 6 micron with a GSD of less than about 1.23. In some embodiments, the toner particles have a particle size of about 3 to about 12 microns. In other embodiments, the toner particles have a particle size of about 6 microns. In other embodiments, the toner particles have a particle size of from about 5 to about 8.5 microns.

In embodiments, toner compositions may be prepared by emulsion-aggregation processes, such as a process that includes aggregating a mixture of an optional colorant, an optional wax and any other desired or required additives, and emulsions including the resins and/or high molecular weight and cross-linked resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization may be accomplished by mixing at about 600 to about 6,000 revolutions per minute, Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 10% by weight, in embodiments from about 0.2% to about 8% by weight, in other embodiments from about 0.5% to about 5% by weight, of the resin in the mixture. This should provide a sufficient amount of agent for aggregation.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time of from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

In embodiments, after aggregation, but prior to coalescence, a resin coating may be applied to the aggregated particles to form a shell thereover. Any resin described above as suitable for forming the core resin may be utilized as the shell. In embodiments, a high molecular weight resin latex as described above may be included in the shell. In yet other embodiments, the high molecular weight resin latex described above may be combined with a resin that may be utilized to form the core, and then added to the particles as a resin coating to form a shell.

The shell resin may be applied to the aggregated particles by any method within the purview of those skilled in the art. In embodiments, the resins utilized to form the shell may be in an emulsion including any surfactant described above. The emulsion possessing the resins, optionally the high molecular weight resin latex described above, may be combined with the aggregated particles described above so that the shell forms over the aggregated particles.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about 5 hours.

In embodiments, a high molecular weight resin in a shell resin may be able to prevent any crystalline resin in the core from migrating to the toner surface. In addition, the resins in the shell may be less compatible with the crystalline resin utilized in forming the core, which may result in a higher toner glass transition temperature ($T_g$), and thus improved charging characteristics may be obtained, including A-zone charging. Moreover, toners of the present disclosure having a high molecular weight resin latex in the core and/or shell may exhibit excellent document offset performance characteristics, as well as reduced peak gloss, in embodiments from about 5 Gardner gloss units (GGU) to about 100 GGU, in other embodiments from about 10 GGU to about 80 GGU, which may be desirable for reproduction of text and images, as some users object to high gloss and the differential which may occur between low gloss and high gloss.

Where the core, the shell, or both includes a branched high molecular weight resin as described above, the presence of the high molecular weight resin may prevent the crystalline resin in the core from migrating to the toner surface. This may especially occur where the high molecular weight resin is present in the shell. In addition, the shell resin(s) may be less compatible with the crystalline resin utilized in forming the core, which may result in a higher toner glass transition temperature (Tg), and thus improved blocking and charging characteristics may be obtained, including A-zone charging. In addition, the high molecular weight resin utilized in the formation of a core-shell particle may have a high viscosity of greater than about 10,000,000 Poise, in embodiments greater than about 50,000,000 Poise, which may be able to prevent any crystalline resin in the core from migrating to the toner surface and thus improve A-zone charging.

In embodiments, the high molecular weight resin utilized in forming the core and/or shell may be present in an amount of from about 2 percent by weight to about 30 percent by weight of the dry toner particles, in embodiments from about 5 percent by weight to about 25 percent by weight of the dry toner particles.

Toner particles possessing a core and or shell possessing a high molecular weight resin as described above may have a glass transition temperature of from about 30° C. to about 80° C., in embodiments from about 35° C. to about 70° C.

Following aggregation to the desired particle size and application of any optional shell, the particles may then be coalesced to the desired final shape, the coalescence being achieved by, for example, heating the mixture to a temperature of from about 45° C. to about 100° C., in embodiments from about 55° C. to about 99° C., which may be at or above the glass transition temperature of the resins utilized to form the toner particles, and/or reducing the stirring, for example to from about 100 rpm to about 1,000 rpm, in embodiments from about 200 rpm to about 800 rpm. Higher or lower temperatures may be used, it being understood that the temperature is a function of the resins used for the binder. Coalescence may be accomplished over a period of from about 0.01 to about 9 hours, in embodiments from about 0.1 to about 4 hours.

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered, One, two, or more surfactants may be utilized. The surfactants may be selected from ionic surfactants and nonionic surfactants. Anionic surfactants and cationic surfactants are encompassed by the term "ionic surfactants," In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPEROMC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, and acids such as abitic acid, which may be obtained from Aldrich, or NEOGEN R™, NEOGEN SC™, NEOGEN RK™ which may be obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

In embodiments, the toner compositions described herein may also include a colorant. Any desired or effective colorant can be employed in the toner compositions, including dyes, pigments, mixtures thereof, and the like, provided that the colorant can be dissolved or dispersed in the ink carrier. Any dye or pigment may be chosen, provided that it is capable of being dispersed or dissolved in the ink carrier and is compatible with the other ink components. The toner compositions can be used in combination with conventional toner ink colorant materials, such as Color Index (C.I.) Solvent Dyes, Disperse Dyes, modified Acid and Direct Dyes, Basic Dyes, Sulphur Dyes, Vat Dyes, and the like. Examples of suitable dyes include Neozapon Red 492 (BASF); Orasol Red G (Ciba); Direct Brilliant Pink B (Oriental Giant Dyes); Direct Red 3BL (Classic Dyestuffs); Supranol Brilliant Red 3BW (Bayer AG); Lemon Yellow 6G (United Chemie); Light Fast Yellow 3G (Shaanxi); Aizen Spilon Yellow C-GNH (Hodogaya Chemical); Bemachrome Yellow GD Sub (Classic Dyestuffs); Cartasol Brilliant Yellow 4GF (Clariant); Ciblanon Yellow 2GN (Ciba); Orasol Black CN (Ciba); Savinyl Black RLSN (Clariant); Pyrazol Black BG (Clariant); Morfast Black 101 (Rohm & Haas); Diaazol Black RN (ICI; Orasol Blue GN (Ciba); Savinyl Blue GLS (Clariant); Luxol Fast Blue MBSN (Pylam Products); Sevron Blue 5GMF (Classic Dyestuffs); Basacid Blue 750 (BASE), Neozapon Black X51 (BASF), Classic Solvent Black 7 (Classic Dyestuffs), Sudan Blue 670 (C.I. 61554) (BASF), Sudan Yellow 146 (C.I. 12700) (BASE), Sudan Red 462 (C.I. 26050) (BASF), C.I. Disperse Yellow 238, Neptune Red Base NB543 (BASE, C.I. Solvent Red 49), Neopen Blue FE-4012 from BASE, Lampronol Black BR from ICI (C.I. Solvent Black 35), Morton Morplas Magenta 36 (C.I. Solvent Red 172), metal phthalocyanine colorants such as those disclosed in U.S. Pat. No. 6,221,137, the disclosure of which is totally incorporated herein by reference, and the like, Polymeric dyes can also be used, such as those disclosed in, for example, U.S. Pat. No. 5,621,022 and U.S. Pat. No. 5,231,135, the disclosures of each of which are herein entirely incorporated herein by reference, and commercially available from, for example, Milliken & Company as Milliken Ink Yellow 869, Milliken Ink Blue 92, Milliken Ink Red 357, Milliken Ink Yellow 1800, Milliken Ink Black 8915-67, uncut Reactant Orange X-38, uncut Reactant Blue X-17, Solvent Yellow 162, Acid Red 52, Solvent Blue 44, and uncut Reactant Violet X-80.

Pigments are also suitable colorants for the toner inks. Examples of suitable pigments include PALIOGEN Violet 5100 (commercially available from BASE); PALIOGEN Violet 5890 (commercially available from BASF); HELIOGEN Green L8730 (commercially available from BASF); LITHOL Scarlet D3700 (commercially available from BASF); SUNEAST Blue 15:4 (commercially available from Sun Chemical); Hostaperm Blue B2G-D (commercially available from Clariant); Hostaperm Blue B4G (commercially available from Clariant); Permanent Red P-F7RK; Hostaperm Violet BL (commercially available from Clariant); LITHOL Scarlet 4440 (commercially available from BASF); Bon Red C (commercially available from Dominion Color Company); ORACET Pink RF (commercially available from Ciba); PALIOGEN Red 3871 K (commercially available from BASF); SUNFAST Blue 15.3 (commercially available from Sun Chemical); PALIOGEN Red 3340 (commercially available from BASF); SUNFAST Carbazole Violet 23 (commercially available from Sun Chemical); LITHOL Fast Scarlet L4300 (commercially available from BASF); SUNBRITE Yellow 17 (commercially available from Sun Chemical); HELIOGEN Blue L6900, L7020 (commercially available from BASF); SUNBRITE Yellow 74 (commercially available from Sun Chemical); SPECTRA PAC C Orange 16 (commercially available from Sun Chemical); HELIOGEN Blue K6902, K6910 (commercially available from BASF); SUNFAST Magenta 122 (commercially available from Sun Chemical); HELIOGEN Blue D6840, D7080 (commercially available from BASF); Sudan Blue OS (commercially available from BASF); NEOPEN Blue FF4012 (commercially available from BASF); PV Fast Blue B2GO1 (commercially available from Clariant); IRGALITE Blue BCA (commercially available from Ciba); PALIOGEN Blue 6470 (commercially available from BASF); Sudan Orange G (commercially available from Aldrich), Sudan Orange 220 (commercially available from BASF); PALIOGEN Orange 3040 (BASF); PALIOGEN Yellow 152, 1560 (commercially available from BASF); LITHOL Fast Yellow 0991 K (commercially available from BASF); PALIOTOL Yellow 1840 (commercially available from BASF); NOVOPERM Yellow FGL (commercially available from Clariant); Ink Jet Yellow 4G VP2532 (commercially available from Clariant); Toner Yellow HG (commercially available from Clariant); Lumogen Yellow D0790 (commercially available from BASF); Suco-Yellow L1250 (commercially available from BASF); Suco-Yellow D1355 (commercially available from BASF); Suco Fast Yellow D1 355, D1 351 (commercially available from BASF); HOSTAPERM Pink E 02 (commercially available from Clariant); Hansa Brilliant Yellow 5GX03 (commercially available from Clariant); Permanent Yellow GRL 02 (commercially available from Clariant); Permanent Rubine L6B 05 (commercially available from Clariant); FANAL Pink D4830 (commercially available from BASF); CINQUASIA Magenta (commercially available from DU PONT); PALTOGEN Black L0084 (commercially available from BASF); Pigment Black K801 (commercially available from BASF); and carbon blacks such as REGAL 330™ (commercially available from Cabot), Nipex 150 (commercially available from Degusssa) Carbon Black 5250 and Carbon Black 5750

(commercially available from Columbia Chemical), and the like, as well as mixtures thereof.

Also suitable are the colorants disclosed in U.S. Pat. No. 6,472,523, U.S. Pat. No. 6,726,755, U.S. Pat. No. 6,476,219, U.S. Pat. No. 6,576,747, U.S. Pat. No. 6,713,614, U.S. Pat. No. 6,663,703, U.S. Pat. No. 6,755,902, U.S. Pat. No. 6,590,082, U.S. Pat. No. 6,696,552, U.S. Pat. No. 6,576,748, U.S. Pat. No. 6,646,111, U.S. Pat. No. 6,673,139, U.S. Pat. No. 6,958,406, U.S. Pat. No. 6,821,327, U.S. Pat. No. 7,053,227, U.S. Pat. No. 7,381,831 and U.S. Pat. No. 7,427,323, the disclosures of each of which are incorporated herein by reference in their entirety, In embodiments, solvent dyes are employed. An example of a solvent dye suitable for use herein may include spirit soluble dyes because of their compatibility with the ink carriers disclosed herein. Examples of suitable spirit solvent dyes include Neozapon Red 492 (BASF); Orasol Red G (Ciba); Direct Brilliant Pink B (Global Colors); Aizen Spilon Red C-BH (Hodogaya Chemical); Kayanol Red 3BL (Nippon Kayaku); Spirit Fast Yellow 3G; Aizen Spilon Yellow C-GNH (Hodogaya Chemical); Cartasol Brilliant Yellow 4GF (Clariant); Pergasol Yellow CGP (Ciba); Orasol Black RLP (Ciba); Savinyl Black RLS (Clariant); Morfast Black Conc. A (Rohm and Haas); Orasol Blue GN (Ciba); Savinyl Blue GLS (Sandoz); Luxol Fast Blue MBSN (Pylam); Sevron Blue 5GMF (Classic Dyestuffs); Basacid Blue 750 (BASF), Neozapon Black XS51 [C.T. Solvent Black, C.I. 12195] (BASF), Sudan Blue 670 [C.I. 61554] (BASE), Sudan Yellow 146 [C.I. 12700] (BASF), Sudan Red 462 [C.I. 260501] (BASF), mixtures thereof and the like.

The colorant may be present in the toner in any desired or effective amount to obtain the desired color or hue such as, for example, at least from about 0.1 percent by weight of the ink to about 50 percent by weight of the ink, at least from about 0.2 percent by weight of the ink to about 20 percent by weight of the ink, and at least from about 0.5 percent by weight of the ink to about 10 percent by weight of the ink.

Optionally, a wax may also be combined with the resin and a colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX polyethylene waxes from Baker Petrolite, wax emulsions available from Michaelman, Inc. and the Daniels Products Company, EPOLENE N-15 commercially available from Eastman Chemical Products, Inc., and VISCOL 550-P, a low weight average molecular weight polypropylene available from Sanyo Kasei K.K.; plant-based waxes, such as camauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550, SUPERSLIP 6530 available from Micro Powder Inc., fluorinated waxes, for example POLYFLUO 190, POLYFLUO 200, POLYSILK 19, POLYSILK 14 available from Micro Powder Inc, mixed fluorinated, amide waxes, for example MICROSPERSION 19 also available from Micro Powder Inc., imides, esters, quaternary amines, carboxylic acids or acrylic polymer emulsion, for example JONCRYL 74, 89, 130, 537, and 538, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2 to about 10 percent by weight of toner and about 90 to about 98 percent by weight of carrier. However, different toner and carrier percentages may be used to achieve a developer composition with desired characteristics.

Toners of the present disclosure can be used in electrostatographic (including electrophotographic) imaging methods. Thus for example, the toners or developers of the disclosure can be charged, such as triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

It is envisioned that the toners of the present disclosure may be used in any suitable procedure for forming an image with a toner, including in applications other than xerographic applications.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

The toners can be utilized for electrostatographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member, Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

EXAMPLES

Resin Emulsion Preparation

Resin Example 1

A 500 mL beaker was charged with 300 grams of methyl ethyl ketone (MEK). While the MEK solution was agitated at 256 rpm, 200 grams of Resin A (a polycondensation product of terephthalic acid and a 1:1 mixture of ethoxylated bisphenol A and propoxylated bisphenol A) was slowly added and the agitation was continued until a clear solution was obtained. This solution was then slowly added to 750 grams of methanol in a 2L beaker under mechanical stirring at 350 rpm. After the second addition, the resulting mixture was stirred for an additional two hours and the resulting precipitate of the purified resin was collected by filtration to remove the excess solvent and further dried under a vacuum at 40° C.,

Resin Comparative Example 1

The resin used in Resin Comparative Example 1 was the exact same resin used in Resin Example 1 (Resin A), except that the resin used for Resin Comparative Example 1 was not subjected to the purification method described in Resin Example 1.

Resin Examples 2-4

Resin Examples 2-4 were prepared in the exact same manner as Resin Example 1 except that Resin A of Resin Example 1 was replaced with Resin B, Resin C and Resin D for Resin Examples 2-4, respectively. Resin B was comprised of the polycondensation product of propoxylated bisphenol A and fumaric acid (see above Formula II). Resin C was a crosslinked version of Resin B, as is described in U.S. Pat. No. 5,227,460, which is incorporated by reference herein in its entirety. Resin D was comprised of the polycondensation product of terephthalic acid, a 1:1 mixture of ethoxylated bisphenol A and propoxylated bisphenol A in combination with a small amount of trimellitlc acid as a branching agent.

Resin Comparative Examples 24

The resins used in Resin Comparative Examples 2-4 were the exact same resins used in Resin Examples 2-4, respectively, except that the resins used for Resin Comparative Examples 2-4 were not subjected to the purification method described above in Resin Example 1.

Analysis: Resin Examples 1-4 and Resin Comparative Examples 1-4

Polyester molecular weights of Resin Examples 1-4 and Resin Comparative Examples 1-4 were determined by gel permeation chromatography (GPC) of the chloroform soluble fraction (0.2 micron filter) on an instrument available from Shimadzu Scientific Instruments Corporation using 2 PL Mixed-C columns available from Polymer Laboratories (Varian, Inc.) against polystyrene standards that ranged from 590 to 841,700 g/mol. Values for $M_n$, $M_p$, $M_w$ and $M_z$ were calculated automatically by software available from Polymer Laboratories. The relative amount of high and low molecular weight resin was calculated as the relative refractive index response factors above and below 1500 mass units for each of the polyester samples. The Acid Numbers of the resins in Resin Examples 1-4 and Resin Comparative Examples 1-4 were measured by titrating the each of the resins with potassium hydroxide (KOH). The amount of fumaric and terephthalic acid units were measured by Ion Chromatography (IC) against calibrated amounts of known standards. Each of these values are shown below in Table 1 and Table 2.

TABLE 1

| Resin | Resin Type | Acid Number (mg KOH/g) | Fumaric Acid by IC (μg/g) | Terephthlaic Acid by IC (μg/g) | $M_n$ | $M_p$ | $M_w$ | Mz |
|---|---|---|---|---|---|---|---|---|
| Ex. 1 | A | 14.1 | 1,200 | 1,400 | 4,852 | 6,140 | 7,546 | 11,547 |
| Comp. Ex. 1 | A | 21.0 | 4,600 | 1,600 | 4,794 | 6,423 | 7,654 | 11,924 |
| Ex. 2 | B | 11.5 | 3,900 | <2 | 6,198 | 7,327 | 13,163 | 34,650 |
| Comp. Ex. 2 | B | 16.3 | 17,000 | 62 | 6,077 | 7,885 | 13,955 | 38,276 |
| Ex. 3 | C | 11.3 | 2,100 | <2 | 6,345 | 6,671 | 21,265 | 160,442 |
| Comp. Ex. 3 | C | 17.8 | 15,000 | <10 | 5,598 | 6,610 | 18,282 | 124,892 |
| Ex. 4 | D | 22.3 | <2 | 170 | 7,129 | 7,248 | 38,393 | 534,108 |
| Comp. Ex. 4 | D | 31.8 | 79 | 1,300 | 6,721 | 7,579 | 24,492 | 103,508 |

TABLE 2

| Resin | Polydispersity ($M_w/M_n$) | % Resin with $M_w$ greater than 1500 Daltons | % Resin with $M_w$ less than 1500 Daltons |
|---|---|---|---|
| Ex. 1 | 1.56 | 90.5 | 9.5 |
| Comp. Ex. 1 | 1.60 | 84.9 | 15.1 |
| Ex. 2 | 2.12 | 96.0 | 4.0 |
| Comp. Ex. 2 | 2.30 | 90.9 | 9.1 |
| Ex. 3 | 3.35 | 97.3 | 2.7 |
| Comp. Ex. 3 | 3.27 | 87.8 | 12.2 |
| Exam. 4 | 5.39 | 92.8 | 7.2 |
| Comp. Ex. 4 | 3.64 | 88.1 | 11.9 |

As shown above in Table 1 the acid number of the purified resin of Resin Examples 1-4 was 4-6 units lower than the unpurified resin of Resin Comparative Examples 1-4. This indicates that the low molecular weight acid species (often associated with poor charge control under humid conditions due to the absorption of water into the toner) have been removed. Such a conclusion is confirmed by the reduction in the amount of fumaric acid and terephthalic acid contaminants (Table 1) and the decrease in the percentage of resin with a $M_w$ less than 1500 Daltons (Table 2).

Toner Preparation

Toner Example 1

A mixture comprised of 55 parts of purified Resin A, as prepared in Resin Example 1, 40 parts of purified Resin D, as prepared in Resin Example 4, and 5 parts of carbon black were premixed by drum-tumbling for 20 minutes. This mixture was then melt-kneaded using a twin-screw extruder. The extrudate was then micronized to a volume median target of 7.6 microns with the addition of 0.3% by weight of a small silica grinding aid and classified to remove fines to a volume median target of 8.3 microns. The parent toner was surface additive blended with small particle, hydrophobically treated fumed silica and titania and zinc stearate, as described in Example 9 of U.S. Pat. No. 6,365,316, which is incorporated by reference herein in its entirety. As a final step, the toners were screened to remove any large particulates.

Toner Comparative Example 1

Toner Comparative Example 1 was prepared in the exact same manner as Toner Example 1, except that resins used in Toner Example 1 were replaced with unpurified resins of Resin Comparative Example 1 and Resin Comparative Example 4, respectively.

Toner Example 2

A mixture of 71 parts of purified Resin B, as prepared in Resin Example 2, 24 parts of purified Resin C, as prepared in Resin Example 3, and 5 parts of carbon black were premixed by drum-tumbling for 20 minutes. This mixture was then melt-kneaded by use of a twin-screw extruder. The extrudate was micronized to a volume median target of 7.6 microns with the addition of 0.3% by weight of a small silica grinding aid and classified to remove fines to a volume median target of 8.3 microns. The parent toner was surface additive blended with small particle, hydrophobically treated fumed silica and titania and zinc stearate as is described in Example 9 of U.S. Pat. No. 6,365,316, which is incorporated by reference herein in its entirety. As a final step, the toners were screened to remove any large particulates.

Toner Comparative Example 2

Toner Comparative Example 2 was prepared in the exact same manner as Toner Example 2, except that resins used in Toner Example 2 were replaced with unpurified resins of Resin Comparative Example 2 and Resin Comparative Example 3, respectively.

The polyester molecular weights of the resins in Toner Examples 1-2 and Resin Comparative Examples 1-2, as described above, using were determined by gel permeation chromatography (GPC). These results are shown below in Table 3.

The respective toners of Toner Examples 1-2 and Toner Comparative Examples 1-2 were tested for their physical properties and the results are presented in Table 3, below.

TABLE 3

| Toner | Resin Type | Fumaric Acid by IC (μg/g) | Terephthlaic Acid by IC (μg/g) | $M_n$ | $M_p$ | $M_w$ | $M_z$ | Polydispersity ($M_w/M_n$) |
|---|---|---|---|---|---|---|---|---|
| Ex. 1 | A/D | 860 | 1,100 | 3,197 | 6,353 | 15,334 | 163,593 | 4.80 |
| Comp. Ex. 1 | A/D | 690 | 1,700 | 2,474 | 6,353 | 9,981 | 43,752 | 4.00 |

TABLE 3-continued

| Toner | Resin Type | Fumaric Acid by IC (μg/g) | Terephthlaic Acid by IC (μg/g) | $M_n$ | $M_p$ | $M_w$ | $M_z$ | Polydispersity ($M_w/M_n$) |
|---|---|---|---|---|---|---|---|---|
| Ex. 2 | B/C | 2600 | <2 | 4,499 | 7,208 | 12,295 | 32,534 | 2.73 |
| Comp. Ex. 2 | B/C | 4500 | 6.2 | 3,196 | 7280 | 11,495 | 33,609 | 3.60 |

TABLE 4

| Toner | % Resin with $M_w$ greater than 1500 Daltons | % Resin with $M_w$ less than 1500 Daltons |
|---|---|---|
| Ex. 1 | 91.1 | 8.9 |
| Comp. Ex. 1 | 85.9 | 14.1 |
| Ex. 2 | 95.1 | 4.9 |
| Comp. Ex. 2 | 89.7 | 10.3 |

As shown above in Tables 3 and 4, the amount of fumaric acid monomer and terephthalic acid monomer and the percentage of resin in the toner with a $M_w$ less than 1500 Daltons both decreased. Such evidence further confirms that the undesirable low molecular weight species were removed from the resins prior to being placed in the toner.

Developer Preparation

Charging characteristics were determined by testing developers made by combining about 4 grams Toner Examples 1-2 and Toner Comparative Examples 1-2 with about 100 grams of carrier (65 micron steel core, Hoeganaes Corporation) coated with about 1% by weight of polymethylmethacrylate. The developers are aggressively mixed in a paint shaker (Red Devil 5400, modified to operate between 600 and 650 RPM) for a period of 10 minutes. It is believed that this process simulates a mechanical energy input to a toner particle equivalent to that applied in a xerographic housing environment in a low toner throughout mode, that is, a xerographic housing producing a print in which from about 0 to about 2 percent of the print is covered by toner developed from that housing for a period of about 100 to about 10,000 impressions. The triboelectric charge is measured for the developers (Developer 1-2 and Comparative Developers 1-2) conditioned in three zones—A-zone (80° F./80% RH), B-zone (70° F./50% RH) and J-zone (70° F./10% RH). These results are illustrated in below Table 5.

TABLE 5

| Developer | Resin | A-tribo 10 min | B-tribo 10 min | J-tribo 10 min | J/A 10 min | J/B 10 min |
|---|---|---|---|---|---|---|
| Ex. 1 | A/D | 20.84 | 44.10 | 63.71 | 3.06 | 1.44 |
| Comp. Ex. 1 | A/D | 14.42 | 42.33 | 65.90 | 4.57 | 1.56 |
| Ex. 2 | B/C | 18.69 | 41.14 | 58.82 | 3.15 | 1.43 |
| Comp. Ex. 2 | B/C | 10.61 | 37.44 | 55.80 | 5.26 | 1.49 |

As shown above in Table 5, the Developers 1 and 2 (containing the purified toner resins) possessed a much higher triboelectric charge in the A-zone. In a machine, this would in turn provide much more consistent prints over a much wider range of ambient conditions and make it simplier to control the printer in spite of changing room conditions.

Printing of Toner Examples 25,000 images were printed on a standard test document on 120 gsm Xerox Digital Color Elite Gloss paper using the toners described in Toner Example 2 and Comparative Toner Example 2. These images were printed to assess the relative degree of fuser roll surface contamination caused by the build-up of a zinc salt, such as for example, zinc fumarate on the fuser roll using FTIR spectroscopic analysis. FTIR spectroscopic analysis determines the relative amount of a contaminant that is deposited on the surface of the fuser roll by comparison of the relative strength of absorption at key wavelengths relative to known calibrated standards. The below Table 6 illustrates the results of this analysis.

TABLE 6

| Toner | Resin | % Zinc Bisacid Surface Coverage | % Viton Surface Coverage | % Resin Surface Coverage |
|---|---|---|---|---|
| Ex. 2 | B/C | 0.61 | 97.4 | 0.26 |
| Comp. Ex. 2 | B/C | 0.82 | 97.2 | 0.36 |

As shown above in Table 6, Toner Example 1 had less fuser roll contamination due to (1) the decreased amount of zinc bisacid surface coverage on the fuser roll than the toner of Comparative Toner Example 1 and (2) the increased amount of Viton Surface Coverage. Brand new fuser rolls have a Viton Surface Coverage of 100%. Furthermore, the resin in Toner Example had a decreased amount of surface coverage on the fuser roll surface.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner comprising:

at least one polyester resin, wherein an amount of free polyvalent acid monomer in the at least one polyester resin is less than 4 mg/gram, and wherein a percentage of polyester resin with a $M_W$ less than 1500 in the at least one polyester resin is less than about 10% of total resin content in the toner, and the at least one polyester resin is reduced in acid number from about 15% to about 35% as compared to a same polyester resin not purified by dissolving the at least one polyester resin in a first solvent and precipitating the at least one polyester resin out of the first solvent using a second solvent that is different from the first solvent.

2. The toner of claim 1, wherein the at least one polyester resin is an amorphous polyester resin, a crystalline polyester resin or combinations thereof.

3. The toner of claim 2, wherein the amorphous polyester resin comprises a polyester selected from the group consisting of polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-isophthalate, polypropylene-isophthalate, polybutylene-isophthalate, polypentylene-isophthalate, polyhexalene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly (ethoxylated bisphenol A-fumarate), poly(ethoxylated bisphenol A-succinate), poly(ethoxylated bisphenol A-adipate), poly(ethoxylated bisphenol A-glutarate), poly(ethoxylated bisphenol A-terephthalate), poly(ethoxylated bisphenol A-isophthalate), poly(ethoxylated bisphenol A-dodecenylsuccinate), poly(propoxylated bisphenol A-fumarate), poly (propoxylated bisphenol A-succinate), poly(propoxylated bisphenol A-adipate), poly(propoxylated bisphenol A-glutarate), poly(propoxylated bisphenol A-terephthalate), poly (propoxylated bisphenol A-isophthalate), poly(propoxylated bisphenol A-dodecenylsuccinate) and combinations thereof.

4. The toner of claim 2, wherein the crystalline polyester resin comprises a polyester selected from the group consisting of poly(ethylene-adipate), poly(propylene-adipate), poly (butylene-adipate), poly(pentylene-adipate), poly(hexylene-adipate), poly(octylene-adipate), poly(ethylene-succinate), poly(propylene-succinate), poly(butylene-succinate), poly (pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly (nonylene-sebacate), poly(decylene-sebacate), poly(undecylene-sebacate), poly(dodecylene-sebacate), poly(ethylene-dodecanedioate), poly(propylene-dodecanedioate), poly (butylene-dodecanedioate), poly(pentylene-dodecanedioate), poly(hexylene-dodecanedioate), poly (octylene-dodecanedioate), poly(nonylene-dodecanedioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), and combinations thereof.

5. The toner of claim 1, wherein an acid component of the free polyvalent acid monomer is selected from the group consisting of terephthalic acid, phthalic acid, isophthalic acid, fumaric acid, maleic acid, itaconic acid, succinic acid, dodecylsuccinic acid, dodecenylsuccinic acid, glutaric acid, adipic acid, pimelic acid, suberic acid, azelic acid, dodecanediacid, oxalic acid, napthalene-2,6-dicarboxylic acid, naphthalene-2,7-dicarboxylic acid, cyclohexane dicarboxylic acid, malonic acid, mesaconic acid, and mixtures thereof.

6. The toner of claim 1, wherein an acid component of the free polyvalent acid monomer is fumaric acid.

7. The toner of claim 1, wherein the toner is further comprised of one or more ingredients selected from the group consisting of colorants, waxes and combinations thereof.

8. The toner of claim 1, wherein the percentage of the at least one polyester resin with a $M_w$ less than 1,500 is less than about 7.5%.

9. A toner comprising:

at least one polyester resin, and at least one high molecular weight additional polyester resin having a $M_w$ greater than about 15,000 and a polydispersity index greater than 4, wherein the at least one high molecular weight polyester resin is present in the toner in an amount of from about 1% to about 30% by weight of the toner, and wherein an amount of free polyvalent acid monomer in the toner is less than 4 mg/gram, and wherein a percentage of polyester resin with a $M_w$ less than 1,500 in the polyester resin and high molecular weight polyester resin is less than about 10% of total resin content in the toner, and the at least one polyester resin is reduced in acid number from about 15% to about 35% as compared to a same polyester resin not purified by dissolving the at least one polyester resin in a first solvent and precipitating the at least one polyester resin out of the first solvent using a second solvent that is different from the first solvent.

10. The toner of claim 9, wherein the at least one polyester resin is an amorphous polyester resin, a crystalline polyester resin and combinations thereof.

11. The toner of claim 10, wherein the amorphous polyester resin comprises a polyester selected from the group consisting of polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-isophthalate, polypropylene-isophthalate, polybutylene-isophthalate, polypentylene-isophthalate, polyhexalene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly (ethoxylated bisphenol A-fumarate), poly(ethoxylated bisphenol A-succinate), poly(ethoxylated bisphenol A-adipate), poly(ethoxylated bisphenol A-glutarate), poly(ethoxylated bisphenol A-terephthalate), poly(ethoxylated bisphenol A-isophthalate), poly(ethoxylated bisphenol A-dodecenylsuccinate), poly(propoxylated bisphenol A-fumarate), poly(propoxylated bisphenol A-succinate), poly(propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate) and combinations thereof.

12. The toner of claim 10, wherein the crystalline polyester resin comprises a polyester selected from the group consisting of poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly(pentylene-dodecanedioate), poly(hexylene-dodecanedioate), poly(octylene-dodecanedioate), poly(nonylene-dodecanedioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), and combinations thereof.

13. The toner of claim 9, wherein an acid component of the free polyvalent acid monomer is selected from the group consisting of terephthalic acid, phthalic acid, isophthalic acid, fumaric acid, maleic acid, itaconic acid, succinic acid, dodecylsuccinic acid, dodecenylsuccinic acid, glutaric acid, adipic acid, pimelic acid, suberic acid, azelic acid, dodecanediacid, oxalic acid, napthalene-2,6-dicarboxylic acid, naphthalene-2,7-dicarboxylic acid, cyclohexane dicarboxylic acid, malonic acid, mesaconic acid, and mixtures thereof.

14. The toner of claim 9, wherein the toner is further comprised of one or more ingredients selected from the group consisting of colorants, waxes and combinations thereof.

15. The toner of claim 9, wherein the percentage of the at least one polyester resin with a $M_w$ less than 1,500 is less than about 7.5%.

16. The toner of claim 9, wherein the toner particles comprise a core with a shell thereover, and wherein the high molecular weight polyester resin is present in the shell.

17. The toner of claim 9, wherein the toner particles comprise a core with a shell thereover, wherein the high molecular weight polyester resin is present in the shell as particles having a diameter of from about 100 nanometers to about 300 nanometers, and wherein the high molecular weight resin particles cover from about 10% to about 90% of a surface of the core.

18. A method of forming a toner comprised of at least one polyester resin, the method comprising: dissolving at least one polyester resin to be used in forming the toner in a first solvent, precipitating the at least one polyester resin out of the first solvent using a second solvent that is different from the first solvent, wherein the dissolving and precipitating reduces the acid number of the at least one polyester resin from about 15% to about 35% as compared to a same polyester resin not purified by the dissolving and precipitating steps to form at least one purified polyester resin, wherein an amount of free polyvalent acid monomer in the at least one purified polyester resin is less than 4 mg/gram and a percentage of polyester resin with a $M_w$ less than 1500 in the at least one purified polyester resin is less than about 10% of total resin content in the toner, and processing the at least one purified polyester resin into a toner particle.

19. The method of claim 18, wherein the solubility parameter of the first solvent is from 8.5 to 11.

* * * * *